US006690098B1

(12) United States Patent
Saldana

(10) Patent No.: US 6,690,098 B1
(45) Date of Patent: Feb. 10, 2004

(54) METHOD AND SYSTEM FOR GATING A POWER SUPPLY IN A RADIATION DETECTOR

(75) Inventor: Michael R. Saldana, New Braunfels, TX (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/494,882

(22) Filed: Jan. 31, 2000

(51) Int. Cl.[7] ..... H01J 31/50
(52) U.S. Cl. ..... 307/125; 250/214 VT
(58) Field of Search ..... 307/125, 115, 307/106, 108; 250/214 VT, 214 LA, 216, 207; 359/353, 537, 807; 327/113, 114, 122, 124, 165, 173, 365

(56) References Cited

U.S. PATENT DOCUMENTS 2,605,409 A * 7/1952 Forbes ..... 327/173
2,752,490 A * 6/1956 Rothstein ..... 327/173
2,793,303 A * 5/1957 Fleisher ..... 327/173
2,846,576 A * 8/1958 Purinton ..... 327/173
3,093,797 A * 6/1963 Lubkin ..... 327/173
3,209,173 A * 9/1965 Rumble ..... 327/173
3,231,765 A * 1/1966 Martin et al. ..... 327/173
3,754,274 A * 8/1973 Auger ..... 342/377
3,843,210 A * 10/1974 Portas et al. ..... 303/168
3,858,030 A * 12/1974 Hart ..... 235/30 R
3,864,595 A * 2/1975 Lawrence et al. ..... 315/12.1
3,980,880 A * 9/1976 D'Agostino ..... 250/214 VT
3,984,728 A * 10/1976 Orlando et al. ..... 315/360
4,025,955 A * 5/1977 Grallien et al. ..... 250/214 VT
4,464,581 A * 8/1984 Oritani ..... 327/172
4,872,057 A * 10/1989 Woolfolk ..... 348/217.1
4,882,481 A * 11/1989 Gilligan et al. ..... 250/214 VT
4,883,975 A * 11/1989 Enomoto et al. ..... 327/73
4,926,039 A * 5/1990 Garfield et al. ..... 250/214 VT
4,952,793 A * 8/1990 Cantrell et al. ..... 250/214 VT
5,059,817 A * 10/1991 Jolivet ..... 327/173
5,204,522 A * 4/1993 Takahashi et al. .... 250/214 VT
5,297,179 A * 3/1994 Tatsumi ..... 327/122
5,323,010 A * 6/1994 Gratton et al. ..... 250/458.1
5,336,881 A * 8/1994 Caserta et al. ..... 250/214 VT
5,453,782 A * 9/1995 Hertel ..... 348/217
5,656,808 A * 8/1997 Marche et al. ..... 250/214 VT
5,672,990 A * 9/1997 Chaw ..... 327/176
5,699,218 A * 12/1997 Kadah ..... 361/13
5,739,710 A * 4/1998 Baik ..... 327/173
5,910,738 A * 6/1999 Shinohe et al. ..... 250/214 LS
5,943,174 A * 8/1999 Bryant et al. ..... 359/353
5,973,315 A * 10/1999 Saldana et al. ..... 250/214 VT
6,072,170 A * 6/2000 Fish ..... 250/214 VT
6,150,650 A * 11/2000 Bowen et al. ..... 250/214 VT
6,157,021 A * 12/2000 Fish ..... 250/214 VT
6,211,709 B1 * 4/2001 Kim ..... 327/173
6,369,622 B1 * 4/2002 Lim et al. ..... 327/122
6,381,480 B1 * 4/2002 Stoddart et al. ..... 600/338
6,429,416 B1 * 8/2002 Porter ..... 250/214 VT

* cited by examiner

*Primary Examiner*—Gregory J. Toatley, Jr.
*Assistant Examiner*—Roberto J. Rios
(74) *Attorney, Agent, or Firm*—Baker Botts L.L.P.

(57) ABSTRACT

The present invention comprises a method for gating a power supply. A gating command terminal is capacitively coupled to an on/off switch. A gating command signal is provided at the gating command terminal. The gating command signal is operable to activate the on/off switch. An off signal is generated at an output terminal of the on/off switch in response to an off state of the on/off switch being activated. An on signal is generated at the output terminal in response to an on state of the on/off switch being activated.

9 Claims, 3 Drawing Sheets

METHOD AND SYSTEM FOR GATING A POWER SUPPLY IN A RADIATION DETECTOR

TECHNICAL FIELD OF THE INVENTION

This invention relates generally to vision systems and more particularly to a method and system for gating a power supply in a radiation detector.

BACKGROUND OF THE INVENTION

There are numerous methods and systems for detecting radiation. In one such system, an image intensifier tube is used to amplify light and allow a user to see images in very dark conditions. These night vision devices typically include a lens to focus light onto the light receiving end of an image intensifier tube and an eyepiece at the other end to view the enhanced imaged produced by the image intensifier tube.

Current image intensifier tubes use photocathodes. Photocathodes emit electrons in response to photons impinging on the photocathodes. The electrons are produced in a pattern that replicates the original scene. The electrons from the photocathode are accelerated towards a microchannel plate. A microchannel plate is typically manufactured from lead glass and has a multitude of microchannels, each one operable to produce a cascade of secondary electrons in response to an incident electron. Therefore, photons impinge on the photocathode producing electrons which are then accelerated to a microchannel plate where a cascade of secondary electrons are produced. These electrons impinge on a phosphorous screen, producing an image of the scene.

Current image intensifier tubes also provide automatic brightness control (ABC) and bright source protection (BSP). ABC maintains a relatively constant level of brightness in the image produced by the image intensifier tube despite fluctuating levels of brightness in the scene being viewed. BSP prevents the image intensifier tube from being damaged by high levels of current that may otherwise be generated in response to an extremely bright source.

Currently available image intensifier tubes provide ABC and BSP by gating a power supply to the photocathode. The term "gating" as used herein refers to the enabling or disabling of the photocathode of an image intensifier by providing an on-state voltage or an off-state voltage to the photocathode with respect to the input of the microchannel plate. These currently available image intensifier tubes generally utilize optical or magnetic coupling for activation of the gating circuit, which is typically floating with respect to the input of the microchannel plate. Drawbacks to these approaches include relatively slow rise/fall times and long delay times, as well as relatively great power requirements and a large number of components. Optical coupling also requires floating low voltage supplies for biasing.

SUMMARY OF THE INVENTION

In accordance with the present invention, the disadvantages and problems associated with previous image intensifiers have been substantially reduced or eliminated. In particular, the present invention provides an improved method and system for gating a power supply in a radiation detector such as an image intensifier.

In one embodiment, a method is provided for gating a power supply. A gating command terminal is capacitively coupled to an on/off switch. A gating command signal is provided at the gating command terminal. The gating command signal is operable to activate the on/off switch. An off signal is generated at an output terminal of the on/off switch in response to an off state of the on/off switch being activated. An on signal is generated at the output terminal in response to an on state of the on/off switch being activated.

Technical advantages of the present invention include providing an image intensifier with improved automatic brightness control and bright source protection. In particular, an image intensifier provides automatic brightness control and bright source protection by gating a power supply to a photocathode utilizing capacitive coupling. As a result, the design is highly compact, drop-in replacement is possible, rise/fall times are decreased, and delay times are reduced.

Other technical advantages include the use of momentary switch action that is possible with transistors. As a result, high speed switching is provided, while a high output impedance for the photocathode is maintained to provide flash protection.

Other technical advantages of the present invention will be readily apparent to those skilled in the art from the following figures, descriptions and claims.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE DRAWINGS

Figure 1:
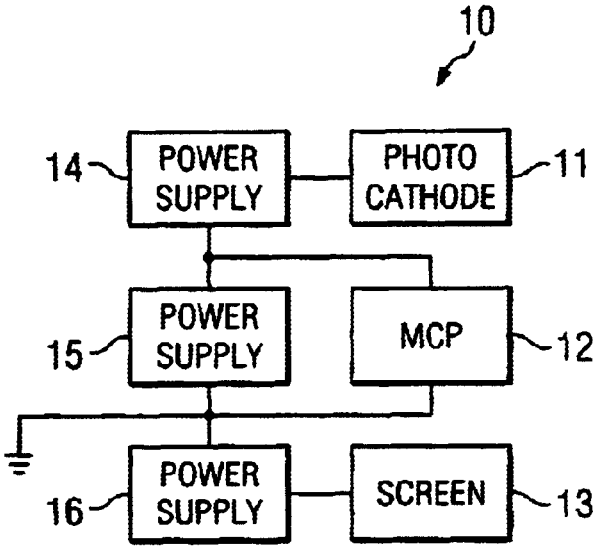
FIG. 1 is a block diagram illustrating a radiation detector such as an image intensifier tube including a power supply for a photocathode in accordance with one embodiment of the present invention.
Figure 2:
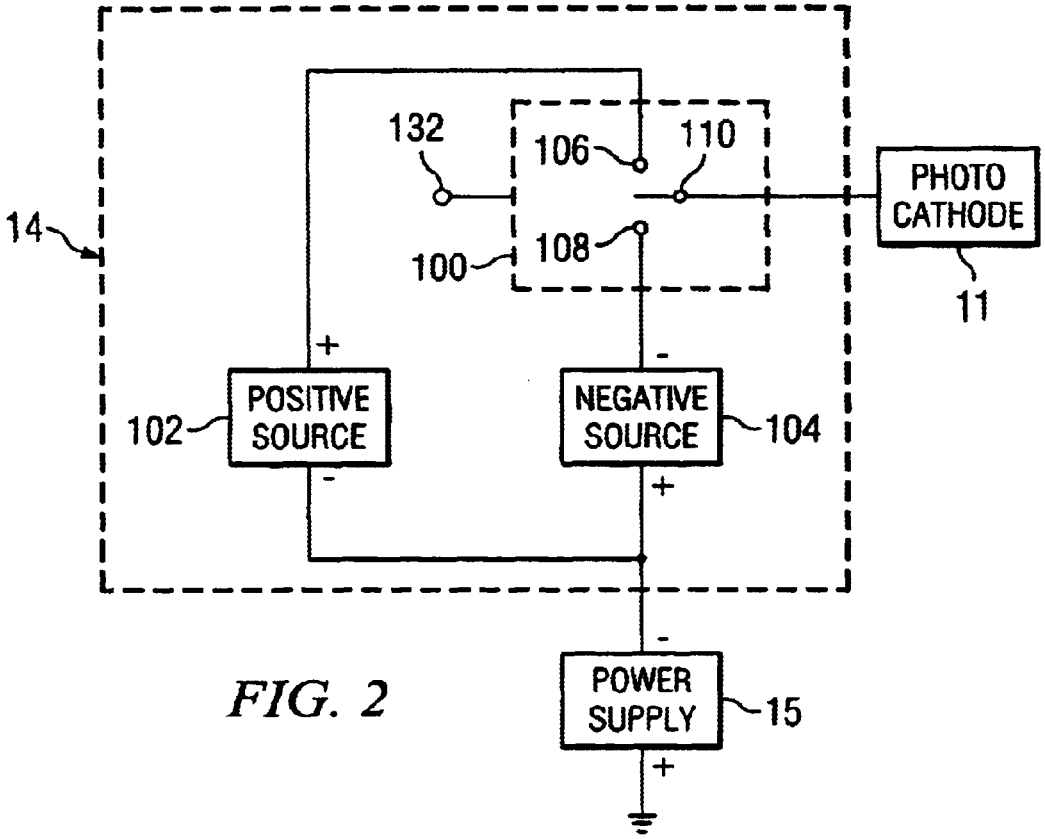
FIG. 2 is a block diagram illustrating a gated power supply to a photocathode in accordance with one embodiment of the present invention.

The preferred embodiment of the present invention and its advantages are best understood by referring to FIGS. 1 through 3 of the drawings, like numerals being used for like and corresponding parts of the various drawings.

An image intensifier is a device that is capable of receiving photons from an image and transforming them into a viewable image. An image intensifier is designed to enhance viewing in varying light conditions, including conditions where a scene is visible with natural vision and conditions where a scene is invisible with natural vision because the scene is illuminated only by star light or other infrared light sources. However, it will be understood that, although an image intensifier may be used to enhance vision, an image intensifier may also be used in other applications involving photon detection, such as systems for inspecting semiconductors.

FIG. 1 is a block diagram illustrating an image intensifier tube 10. The image intensifier tube 10 includes a photocathode 11, a microchannel plate (MCP) 12, and a phosphorous screen 13. The image intensifier tube 10 also comprises a plurality of power supplies 14, 15 and 16. In operation, photons from an image impinge on an input side of the photocathode 11. The photocathode 11 converts photons into electrons, which are emitted from an output side of the photocathode 11 in a pattern representative of the original image. Typically, the photocathode 11 is a circular, disk-like structure manufactured from semiconductor materials mounted on a substrate. One suitable arrangement is gallium arsenide (GaAs) mounted on glass, fiber optics or other similarly transparent substrate.

The electrons emitted from the photocathode 11 are accelerated in a first electric field that is located between the photocathode 11 and an input side of the MCP 12. Thus, after accelerating in the first electric field which is generated by the power supply 14, the electrons impinge on the input side of the MCP 12.

The MCP 12 typically comprises a thin glass wafer formed from many hollow fibers, each oriented slightly off axis with respect to incoming electrons. The MCP 12 typically has a conductive electrode layer disposed on its input and output sides. A differential voltage, supplied by the power supply 15, is applied across the input and output sides of the MCP 12 to generate a second electric field. Electrons from the photocathode 11 enter the MCP 12 where they produce secondary electrons, which are accelerated by the second electric field. The accelerated secondary electrons leave the MCP 12 at its output side.

After exiting the MCP 12, the secondary electrons are accelerated in a third electric field that is located between the output side of the MCP 12 and the screen 13. The third electric field is generated by the power supply 16. After accelerating in the third electric field, the secondary electrons impinge on the screen 13, where a pattern replicating the original image is formed.

FIG. 2 is a block diagram illustrating a gated power supply 14 to a photocathode 11 in accordance with one embodiment of the present invention. The gated power supply 14 provides a relatively constant brightness for the image seen by a user of an image intensifier. The power supply 14 comprises a switching network 100, a positive voltage source 102 and a negative voltage source 104. The sources 102 and 104 provide voltages with reference to the voltage supplied by the power supply 15 at the input side of the MCP 12. The positive source 102 and the negative source 104 may be coupled to each other, and the sources 102 and 104 may also be coupled to the power supply 15 to the MCP 12.

The switching network 100 comprises a positive terminal 106, a negative terminal 108 and a photocathode, or output, terminal 110. The positive terminal 106 is coupled to the positive source 102, the negative terminal 108 is coupled to the negative source 104, and the photocathode terminal 110 is coupled to the photocathode 11. Thus, the switching network 100 may couple the photocathode 11 to the positive source 102 or to the negative source 104 by coupling the photocathode terminal 110 to either the positive terminal 106 or the negative terminal 108. In addition, the switching network 100 may place the photocathode 11 in an open circuit position such that the photocathode terminal 110 is coupled to neither the positive terminal 106 nor the negative terminal 108. As an alternative, the switching network 100 may be configured to couple the photocathode 11 to the positive source 102 and the negative source 104 without an open circuit position being available.

In operation, while the photocathode 11 is coupled by the switching network 100 to the negative source 104, the photocathode 11 functions as described above in connection with FIG. 1. In this configuration, the power supply 14 provides a constant negative voltage to the photocathode 11 through the negative source 104. In one embodiment, this voltage level is approximately −800 volts. However, when the switching network 100 couples the photocathode 11 to the positive source 102, the first electric field is directed such that essentially no electrons reach the MCP 12 and the photocathode 11 is effectively forced into a non-functioning state. In this configuration, the power supply 14 provides a constant positive voltage to the photocathode 11 through the positive source 102. In one embodiment, this voltage level is approximately +40 volts with reference to the input of the MCP 12.

Figure 3A:
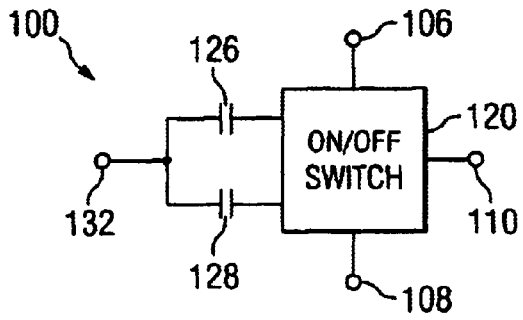
FIGS. 3A–B are block diagrams illustrating embodiments of the switch for the gated power supply of FIG. 2 constructed in accordance with the teachings of the present invention.

FIG. 3A is a block diagram illustrating one embodiment of the switching network 100 for the gated power supply 14 of FIG. 2. The switching network 100 comprises an on/off switch 120, an off coupling capacitor 126 and an on coupling capacitor 128.

In operation, a gating command signal is received at a gating command terminal 132. Based on the rise/fall direction of the gating command signal, an on state or an off state of the on/off switch 120 is activated. When the off state of the on/off switch 120 is activated, the positive terminal 106 is coupled to the photocathode terminal 110. This provides a positive voltage from the positive source 102 to the photocathode 11, turning the photocathode 11 off. Conversely, when the on state of the on/off switch 120 is activated, the negative terminal 108 is coupled to the photocathode terminal 110. This provides a negative voltage from the negative source 104 to the photocathode 11, turning the photocathode 11 on.

Figure 3B:
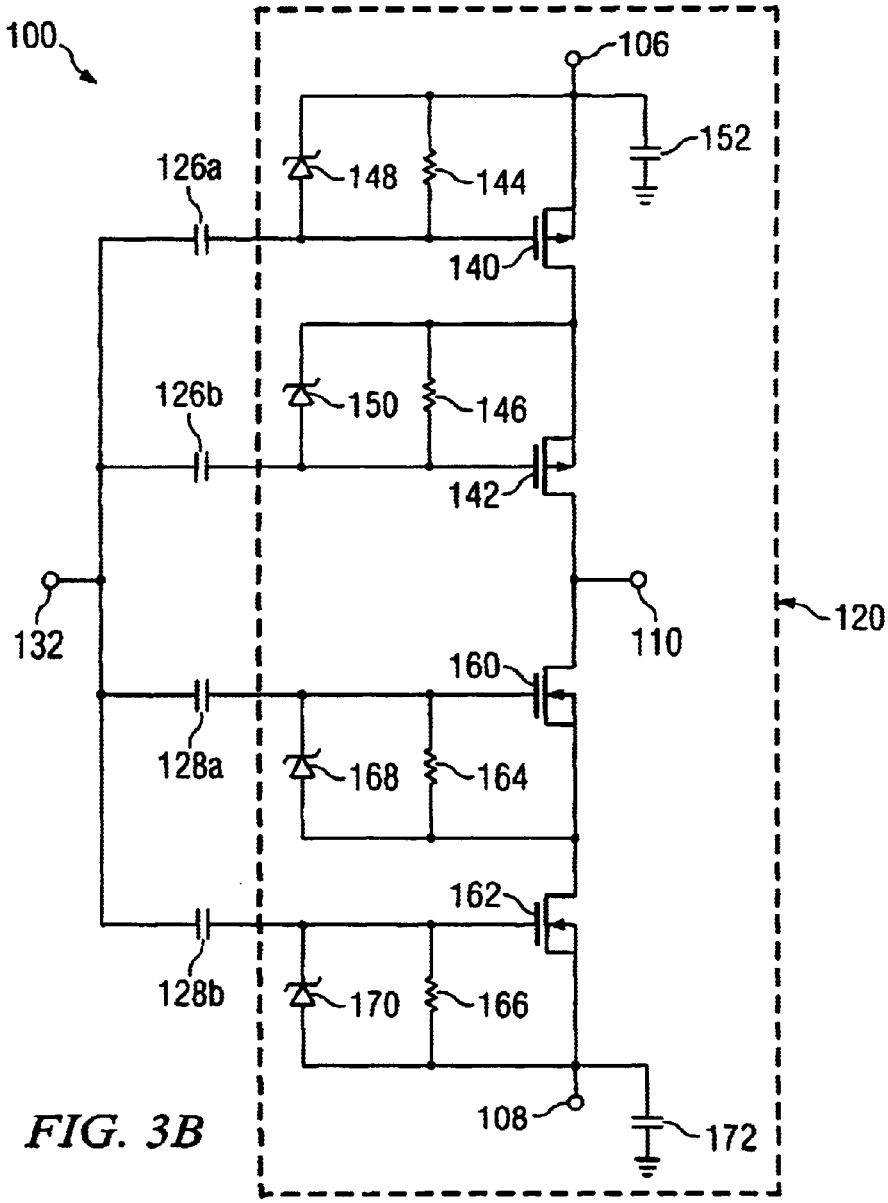

FIG. 3B is a block diagram illustrating one embodiment of the switching network 100 of FIG. 3A. In this embodiment, the on/off switch 120 comprises a first off transistor 140, a second off transistor 142, a first off resistor 144, a second off resistor 146, a first off zener diode 148, a second off zener diode 150 and an off capacitor 152. The off transistors 140 and 142 may comprise p-channel, high voltage mosfets or other suitable transistors. While the first off transistor 140 is activated, voltage may discharge through the first off resistor 144 to prevent crossover. The second off resistor 146 has a high enough impedance to prevent the gate of the second off transistor 142 from following the source so closely that the second off transistor 142 would not activate properly. In an exemplary embodiment, the first off resistor 144 may be approximately one kΩ and the second off resistor 146 may be approximately one MΩ. The off zener diodes 148 and 150 may be configured to clamp out at approximately 15 V in order to protect the off transistors 140 and 142. The off capacitor 152, which may be approximately 1,000 pF, provides a path to ground for the gating command signal. The positive terminal 106 is coupled to a positive source 102 of approximately +40 V in this embodiment.

The on/off switch 120 further comprises a first on transistor 160, a second on transistor 162, a first on resistor 164, a second on resistor 166, a first on zener diode 168, a second on zener diode 170 and an on capacitor 172. The on transistors 160 and 162 may comprise n-channel, high voltage mosfets or other suitable transistors. While the second on transistor 162 is activated, voltage may discharge through the second on resistor 166 to prevent crossover. The first on resistor 164 has a high enough impedance to prevent the gate of the first on transistor 160 from following the source so closely that the first on transistor 160 would not activate properly. In the exemplary embodiment, the first on resistor 164 may be approximately one MΩ and the second on resistor 166 may be approximately one kΩ. The on zener diodes 168 and 170 may be configured to clamp out at approximately 15 V in order to protect the on transistors 160 and 162. The on capacitor 172, which may be approximately 1,000 pF, provides a path to ground for the gating command signal. The negative terminal 108 is coupled to a negative source 104 of approximately −800 V in this embodiment.

For the embodiment shown in FIG. 3B, the gating command terminal 132 is coupled to the on/off switch 120 through a pair of off capacitors 126*a* and 126*b* and a pair of on capacitors 128*a* and 128*b*. According to the exemplary embodiment, the capacitors 126*a* and 128*b* are each approximately 1,000 pF, while the capacitors 126*b* and 128*a* are each approximately 100 pF.

In operation, a high gating command signal, for example approximately 15 V, is provided at the gating command terminal 132. This high signal deactivates the off transistors 140 and 142 by turning off the off transistors 140 and 142 to an open state. When the high signal is received at the on transistors 160 and 162, the second on transistor 162 is activated first and the drain of the second on transistor 162 drops toward −800 V. As the second on transistor 162 transitions toward −800 V, a gate-to-source voltage is developed at the first on transistor 160. This activates the first on transistor 160 and the drain of the first on transistor 160 also drops toward −800 V. Because the off transistors 140 and 142 are deactivated, the voltage at the photocathode terminal 110 is approximately −800 V. Thus, the on state of the on/off switch 120 is activated and the photocathode 11 is turned on.

As the gate-to-source voltage of the second on transistor 162 discharges through the second on resistor 166 and falls below a threshold value, the second on transistor 162 is deactivated. This in turn deactivates the first on transistor 160 because of the absence of a current path for maintaining the gate-to-source voltage of the first on transistor 160.

Next a low gating command signal, for example approximately 0 V, is provided at the gating command terminal 132. This low signal deactivates the on transistors 160 and 162, if not previously deactivated as described above. When the low signal is received at the off transistors 140 and 142, the first off transistor 140 is activated first and the drain of the first off transistor 140 rises toward +40 V. As the first off transistor 140 transitions toward +40 V, a gate-to-source voltage is developed at the second off transistor 142. This activates the second off transistor 142 and the drain of the second off transistor 142 also rises toward +40 V. Because the on transistors 160 and 162 are deactivated, the voltage at the photocathode terminal 110 is approximately +40 V. Thus, the off state of the on/off switch 120 is activated and the photocathode 11 is turned off.

As the gate-to-source voltage of the first off transistor 140 discharges through the first off resistor 144 and falls below a threshold value, the first off transistor 140 is deactivated. This in turn deactivates the second off transistor 142 because of the absence of a current path for maintaining the gate-to-source voltage of the second off transistor 142.

Thus, the transistors 140, 142, 160 and 162 are only momentarily activated in comparison to the cycle length of the gating command signal. While all of the transistors 140, 142, 160 and 162 are deactivated, the existing voltage at the photocathode terminal 110 discharges at a rate that is proportional to the current in the photocathode 11 and inversely proportional to a parasitic capacitance between the photocathode 11 and the MCP 12. This discharge rate is kept low in order to enable the momentary action of the transistors 140, 142, 160 and 162 to suffice in producing an appropriate signal to the photocathode 11.

In an alternative embodiment, the negative source 104 provides approximately −400 V to the negative terminal 108. In this embodiment, the on/off switch 120 comprises a single off transistor 140, a single off resistor 144, a single off zener diode 148, a single on transistor 160, a single on resistor 166 and a single on zener diode 168. In addition, the gating command terminal 132 is coupled to the on/off switch 120 through a single off capacitor 126 and a single on capacitor 128.

Figure 4:
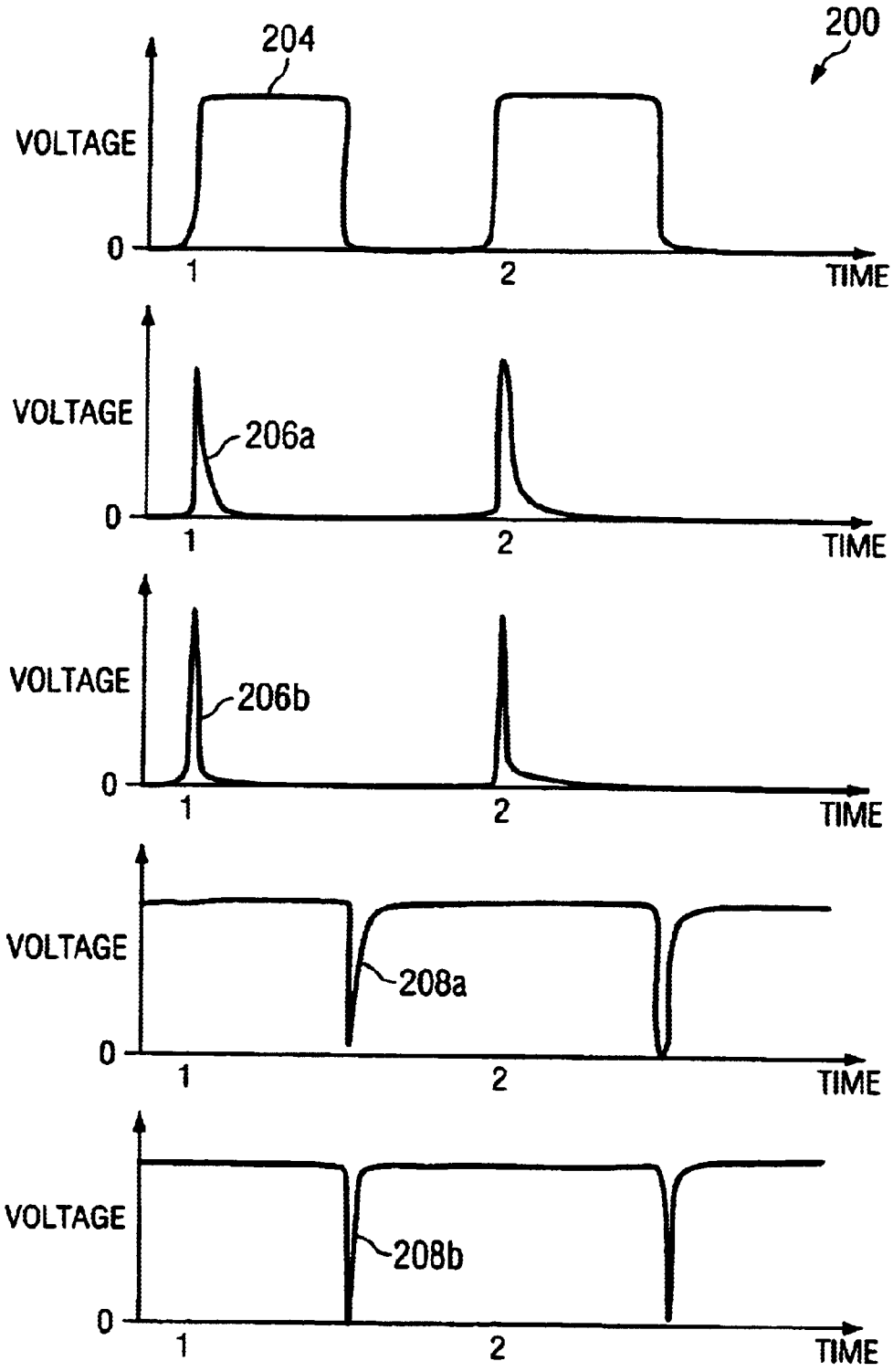
FIG. 4 is a graph illustrating an on signal, an off signal, and a gating command signal.

FIG. 4 is a graph 200 illustrating example voltages for a gating command signal 204, on signals 206*a–b*, and off signals 208*a–b* with respect to time. According to the illustrated embodiment, the on signal 206*a* is generated by the on transistor 162, and the on signal 206*b* is generated by the on transistor 160. The pulse width of an on signal 206*a–b* is less than the pulse width of the gating command signal 204. The off signal 208*a* is generated by the off transistor 140, and the off signal 208*b* is generated by the off transistor 142. The pulse width of an off signal 208*a–b* is less than the pulse width of the gating command signal 206.

While the invention has been particularly shown and described by the foregoing detailed description, it will be understood by those skilled in the art that various other changes in form and detail may be made without departing from the spirit and scope of the invention.

What is claimed is:

1. A method for gating a power supply, comprising:

capacitively coupling a gating command terminal to an on/off switch;

providing a positive voltage source and a negative voltage source at the on/off switch;

providing a gating command signal at the gating command terminal, the gating command signal operable to activate the on/off switch;

generating an off signal at an output terminal of the on/off switch in response to an off state of the on/off switch being activated, a pulse width of the off signal being less than a pulse width of the gating command signal; and generating an on signal at the output terminal of the on/off switch in response to an on state of the on/off switch being activated, a pulse width of the on signal being less than the pulse width of the gating command signal.

2. The method of claim 1, generating an off signal at the output terminal comprising coupling the positive voltage source to the output terminal and generating an on signal at the output terminal comprising coupling the negative voltage source to the output terminal.

3. The method of claim 1, wherein the step of capacitively coupling the gating command terminal to the on/off switch comprises:

coupling the gating command terminal to a first and second capacitor, and coupling the first and second capacitors to the on/off switch.

4. A system for gating a power supply, comprising:

an on/off switch;

a positive voltage source and a negative voltage source coupled to the on/off switch;

a gating command terminal coupled to the on/off switch, the gating command terminal operable to provide a gating command signal to the on/off switch, the gating command signal operable to alternatively activate an on state and an off state of the on/off switch; and first and second capacitors coupled to the gating command terminal and the on/off switch, an off signal being generated at an output terminal of the on/off switch for a time less than a pulse width of the gating command signal in response to the off state being activated, an on signal being generated at the output terminal of the on/off switch for a time less than the pulse width of the gating command signal in response to the on state being activated.

5. The system of claim 4, wherein the positive voltage source is coupled to the output terminal to generate the off signal at the output terminal and the negative voltage source is coupled to the output terminal to generate the on signal at the output terminal.

6. The system of claim 4, the on/off switch having an open circuit position between the on state and the off state.

7. A switching network for providing an alternating signal, comprising:

an on/off switch comprising an output terminal;

a positive voltage source and a negative voltage source coupled to the on/off switch; and a gating command terminal for providing a gating command signal capacitively coupled to the on/off switch, the gating command signal operable to activate an on state and an off state of the on/off switch such that an on signal is provided at the output terminal for a time less than a pulse width of the gating command signal while the on state is activated, and an off signal is provided at the output terminal for a time less than a pulse width of the gating command signal while the off state is activated, the gating command signal being operable to alternatively activate the on state and the off state.

8. The system of claim 7, wherein the positive voltage source is coupled to the output terminal to generate the off signal at the output terminal and the negative voltage source is coupled to the output terminal to generate the on signal at the output terminal.

9. The system of claim 7, further comprising first and second capacitors coupled to the gating command terminal and the on/off switch.

* * * * *